US011480407B2

(12) United States Patent
Grace et al.

(10) Patent No.: US 11,480,407 B2
(45) **Date of Patent: *Oct. 25, 2022**

(54) ARCHERY TRAINING GRIP AND RELATED METHOD

(71) Applicant: Grace Engineering Corp., Memphis, MI (US)

(72) Inventors: Nathaniel E. Grace, Fort Gratiot, MI (US); Cody M. Schulz, Harrison Township, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/238,783

(22) Filed: Apr. 23, 2021

(65) Prior Publication Data

US 2021/0239422 A1 Aug. 5, 2021

Related U.S. Application Data

(63) Continuation of application No. 16/585,746, filed on Sep. 27, 2019, now Pat. No. 11,015,897.

(60) Provisional application No. 62/757,923, filed on Nov. 9, 2018.

(51) Int. Cl.
*F41B 5/14* (2006.01)

(52) U.S. Cl.
CPC ..... *F41B 5/1476* (2013.01)

(58) Field of Classification Search
CPC ..... F41B 5/1476; F41B 5/1484; F41B 5/00; F41B 5/01; F41B 5/0031; F41B 5/10
USPC ..... 124/88, 23.1, 25.6
See application file for complete search history.

(56) References Cited

U.S. PATENT DOCUMENTS

| | | | | |
|---|---|---|---|---|
| 4,787,361 | A * | 11/1988 | Vyprachticky | F41B 5/14 124/24.1 |
| 5,081,979 | A | 1/1992 | Burling | |
| 5,119,796 | A * | 6/1992 | Dehlbom | F41B 5/0031 124/88 |
| 5,241,945 | A * | 9/1993 | Shepley, Jr. | F41B 5/0031 124/88 |
| 5,243,958 | A * | 9/1993 | Shepley, Jr. | F41B 5/0031 124/88 |
| 5,469,834 | A * | 11/1995 | Higgins | F41B 5/14 124/88 |
| 5,551,413 | A * | 9/1996 | Walk | F41B 5/14 124/88 |
| 8,622,052 | B1 | 1/2014 | McPherson | |
| 10,648,761 | B1 * | 5/2020 | Elezar | F41B 5/00 |
| 11,015,897 | B2 * | 5/2021 | Grace | F41B 5/1476 |
| 2003/0070669 | A1 * | 4/2003 | Beville | F41B 5/0031 124/88 |

(Continued)

*Primary Examiner* — John E Simms, Jr.
(74) *Attorney, Agent, or Firm* — Warner Norcross + Judd, LLP

(57) ABSTRACT

An archery training aid is provided including a body and a finger rest extending outward at an angle from a base. The finger rest can include a finger rest surface configured to engage one or more fingers of a hand. The base can be configured to be placed in engagement with a first lateral grip surface of a bow grip so that the finger rest surface is disposed at a first angle between 25° to 65°, inclusive, or between 30° and 50°, inclusive, relative to the first lateral grip surface. A related method of use is provided to impair or prevent bow torque imparted by an archer's hand on a bow.

20 Claims, 9 Drawing Sheets

(56) References Cited

U.S. PATENT DOCUMENTS

| | | | | |
|---|---|---|---|---|
| 2007/0084451 | A1* | 4/2007 | Perry | F41B 5/14 124/88 |
| 2007/0084453 | A1* | 4/2007 | Sheliga | F41B 5/14 124/88 |
| 2010/0051635 | A1 | 3/2010 | Nelson et al. | |
| 2011/0259309 | A1* | 10/2011 | Oppenheim | F41B 5/14 124/88 |
| 2012/0272425 | A1* | 11/2012 | Peck | F41B 5/1473 2/16 |
| 2014/0196705 | A1* | 7/2014 | White | F41B 5/0031 124/88 |
| 2014/0366858 | A1* | 12/2014 | Garver | F41B 5/10 29/428 |
| 2015/0211824 | A1 | 7/2015 | Vyprachticky | |
| 2016/0138885 | A1* | 5/2016 | White | F41G 3/06 124/87 |
| 2020/0149839 | A1* | 5/2020 | Grace | F41B 5/1476 |

* cited by examiner

ARCHERY TRAINING GRIP AND RELATED METHOD

BACKGROUND OF THE INVENTION

The present invention relates to archery products, and more particularly to a training aid for mastering proper grip of an archery bow.

Conventional vertical bows, such as compound bows, recurves and long bows typically include a hand grip associated with a riser that is further joined with limbs between which a bowstring is strung. The bow can include an arrow rest on the riser that supports an arrow. The bowstring includes a nocking point where an opposite end of the arrow is supported on the bowstring.

To draw a vertical bow, an archer will grasp the hand grip with one hand and engage the bowstring with their other hand via their digits or an archery release aid. The archer will then pull the bowstring away from the riser and/or limbs to a drawn configuration, with the arrow still on the arrow rest and supported on the bowstring. While the bow is fully drawn, the archer will acquire a target visually or with a sight mounted to the bow. Then the archer will release the bowstring so that the energy stored in the limbs is translated through the bowstring to propel the arrow along a trajectory. As the arrow initially moves forward, it slides along the arrow rest until eventually all of the arrow clears the arrow rest and embarks upon its flight trajectory.

As the bow is drawn, and when the arrow is being shot, the archer's hand engages the hand grip. The position and orientation of the gripping hand thus has an effect on the arrow because the hand can inadvertently torque the grip, and thus the riser and the arrow rest, thereby affecting arrow flight. For example, if the hand is improperly placed on the grip, the bow's riser and limbs will naturally turn in that hand when the bow is drawn, under the force of the draw. When the bowstring is released, the riser will then spring back to accommodate the improper hand position. As a result, the arrow rest will move with the riser, and thereby alter its engagement with the arrow, typically causing erratic arrow flight, with the arrow thrown to the left or the right in an inconsistent manner. Accordingly, this will cause inconsistent shot placement and compromise accuracy.

To address hand placement relative to the grip and reduce or preferably eliminate the application of bow torque generated by the hand as the bow is drawn, an archer typically has to practice and be extremely diligent about how they engage the grip with their bow hand. To some archers, good hand placement will come quickly or naturally, while to others, it will take work to perfect the grip and eliminate torque.

While the archery industry has attempted to address bow torque with grips that float relative to a bow riser, or other shaped devices that an archer holds in their hand between the grip and the palm, these products many times fall short of assisting an archer in perfecting hand placement and grip to completely address excessive bow torque.

Accordingly, there remains room for improvement with regard to products that can assist archers in achieving better hand placement to address bow torque in the field of archery.

SUMMARY OF THE INVENTION

An archery bow training aid and related method are provided to reduce torque applied to the archery bow via a grip hand when an archery bow is drawn.

In one embodiment, the training aid can include a body, constructed from a rigid material, and a finger rest extending outward at an angle from a base. The finger rest can include a finger rest surface configured to engage one or more fingers of a hand. The base can be configured to be placed in engagement with a first lateral grip surface of a bow grip so that the finger rest surface is disposed at a first angle between 25° to 65°, inclusive, or between 30° and 50°, inclusive, relative to the first lateral grip surface.

In another embodiment, the training aid can include a fastening element joined with at least one of the base and the finger rest. The fastening element can be configured to secure the base in a fixed orientation relative to a grip of the archery bow and under a shelf of the archery bow.

In still another embodiment, the training aid body can include an upper body portion and a lower body portion. The fastening element can be joined with the upper body portion. The lower body portion can include the base, and can be configured to engage the first lateral grip surface.

In yet another embodiment, the fastening element can be configured to extend over a portion of a shelf of the bow above the first lateral grip surface when another portion of the aid body, such as the base, is adjacent the first lateral grip surface.

In even another embodiment, the fastening element can be in the form of a clip. The clip can include a first arm and a second arm with a gap therebetween. The gap can be dimensioned to receive a portion of the riser, grip or shelf. For example, the shelf can include a shelf ridge. The first arm and second arm can be configured to spread away from one another when the clip is advanced over the shelf ridge so the shelf ridge enters into the gap.

In a further embodiment, the shelf and/or shelf ridge can include a recess. One or both of the clip arms can include a protrusion. This protrusion can snap into the recess when the clip engages with the shelf to secure the body to the riser.

In still a further embodiment, the fastening element can be a fastener. The fastener can be configured to extend through at least one of the upper body portion, the base and the finger rest. The fastener also can be configured to extend through the first lateral grip surface to secure the aid body to the riser. The fastener can be threaded, and the grip surface and/or riser can define a corresponding threaded hole.

In yet a further embodiment, a method of using an archery training aid is provided. The method can include securing the body to an archery bow with a fastening element in a fixed orientation relative to a grip of the archery bow and under a shelf of the archery bow, with the finger rest disposed at a first angle between 30° and 50°, inclusive, relative to the first lateral grip surface.

In even a further embodiment, the method can include grasping the grip and the training aid body with a hand so that at least one finger of the hand are adjacent the finger rest surface, and a knuckle reference line of the hand aligns generally at the first angle between 25° and 65°, inclusive, or between 30° and 50°, inclusive, relative to the first lateral grip surface. A thumb of the hand can be disposed adjacent a second lateral grip surface of the grip opposite the first lateral grip surface. The training aid body can reduce torque applied to the archery bow via the hand when the archery bow is drawn.

In another, further embodiment, the method can include using a clip as the fastening element. The securing can include clipping the clip to the shelf or other portion of the archery bow. Optionally, the clip includes a first arm and a second arm with a gap therebetween. The securing can include placing the shelf or other bow portion in the gap.

In still another, further embodiment, the clip can include a front opening, a rear opening and a side opening. The securing can include pushing the shelf ridge or other bow portion into the gap through the side opening so a first arm and a second arm spread away from one another, then move back toward one another after the portion is fully inserted in the clip.

In yet another, further embodiment, the shelf ridge and/or the shelf can include a recess and a clip arm can include a protrusion. The protrusion can snap into the recess during the securing step.

In even another further embodiment, the clip can include a front opening, a rear opening and a side opening. The securing can include sliding the shelf ridge into the gap through the front opening and/or the rear opening.

The archery training aid and related method of the current embodiments can train an archer to properly hold an archery bow when drawing and shooting the bow to thereby reduce and/or eliminate bow torque transferred by the archer's hand to the bow riser. In turn, this can improve the archer's shooting technique, promote consistent arrow flight and improve shot accuracy.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
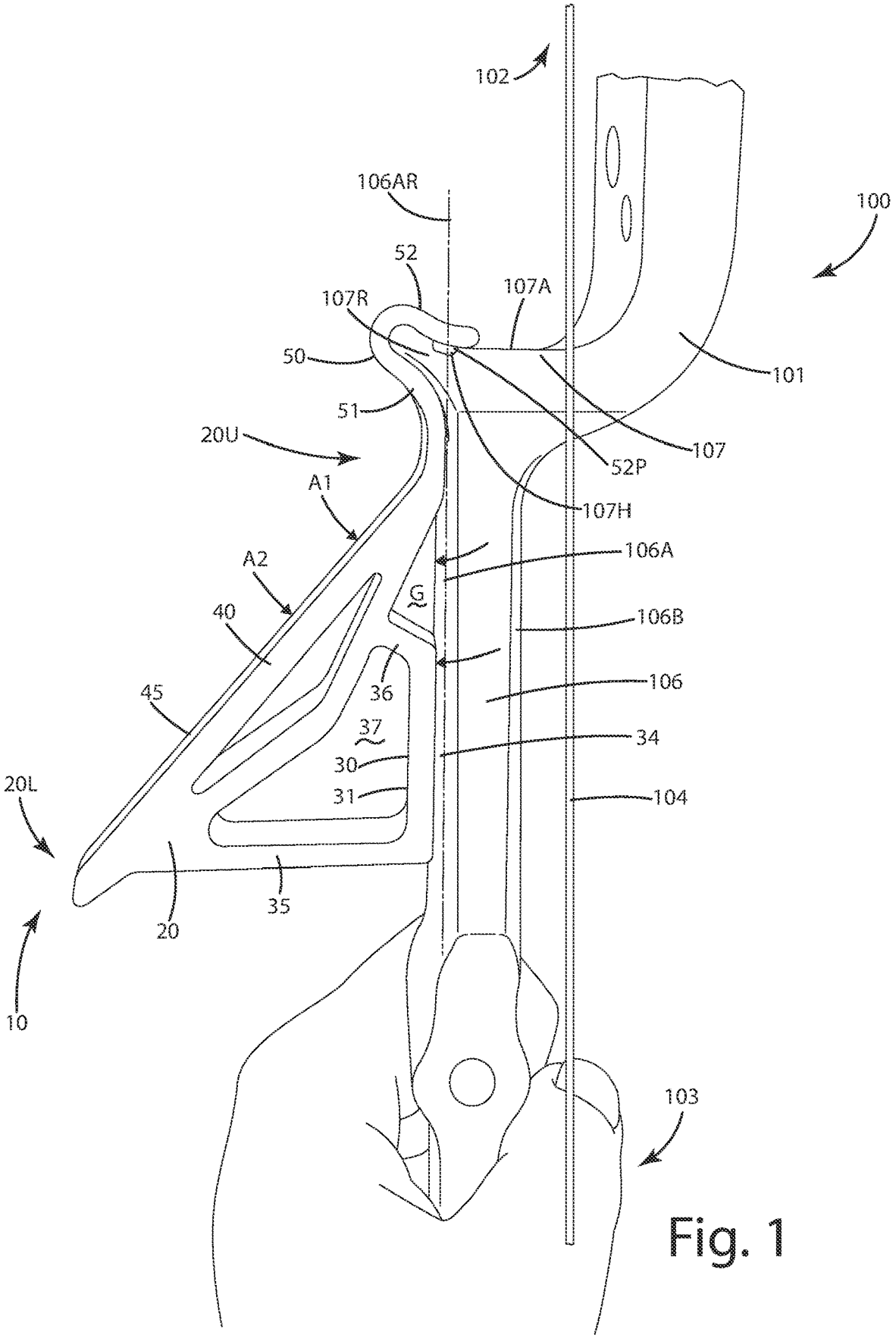
FIG. 1 is a rear view of an archery grip training aid of a current embodiment used on an archery bow.
Figure 2:
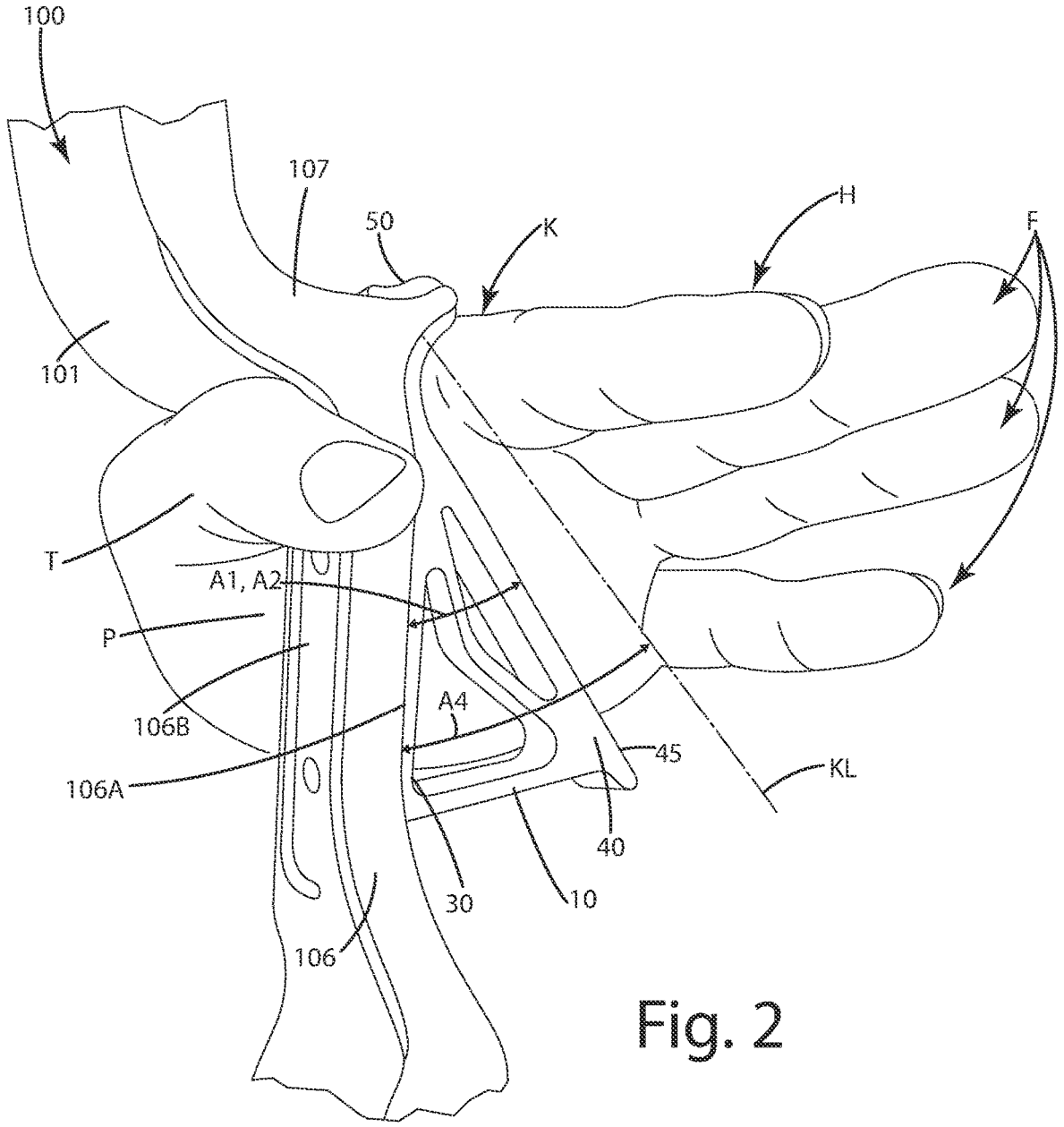
FIG. 2 is a perspective front view of the training aid installed on an archery bow and positioning an archer's hand as the hand engages the grip.
Figure 3:
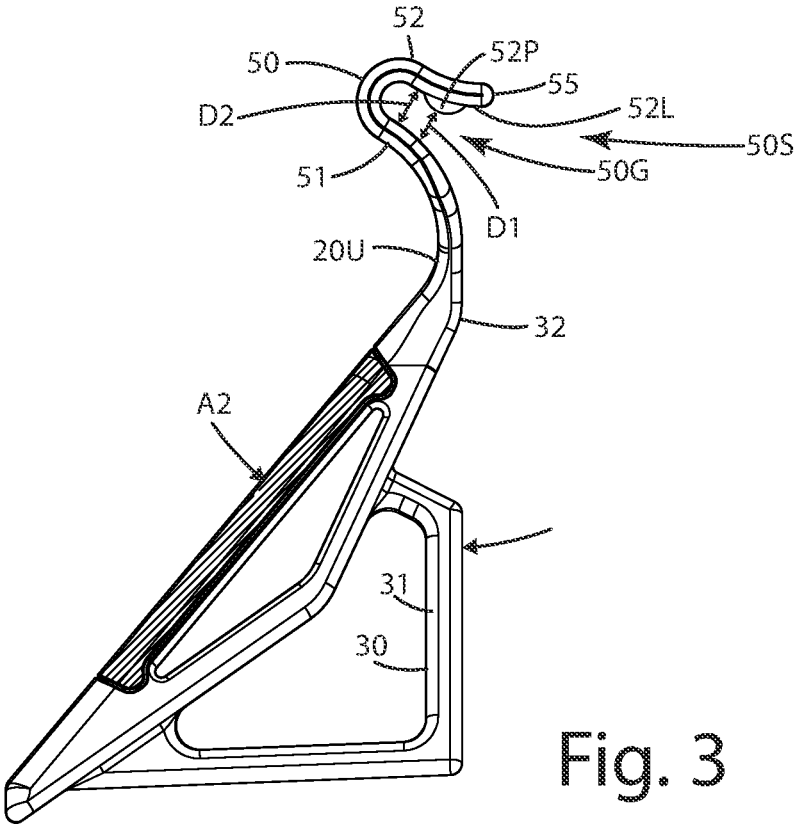
FIG. 3 is a rear view of the training aid before installation on an archery bow.
Figure 4:
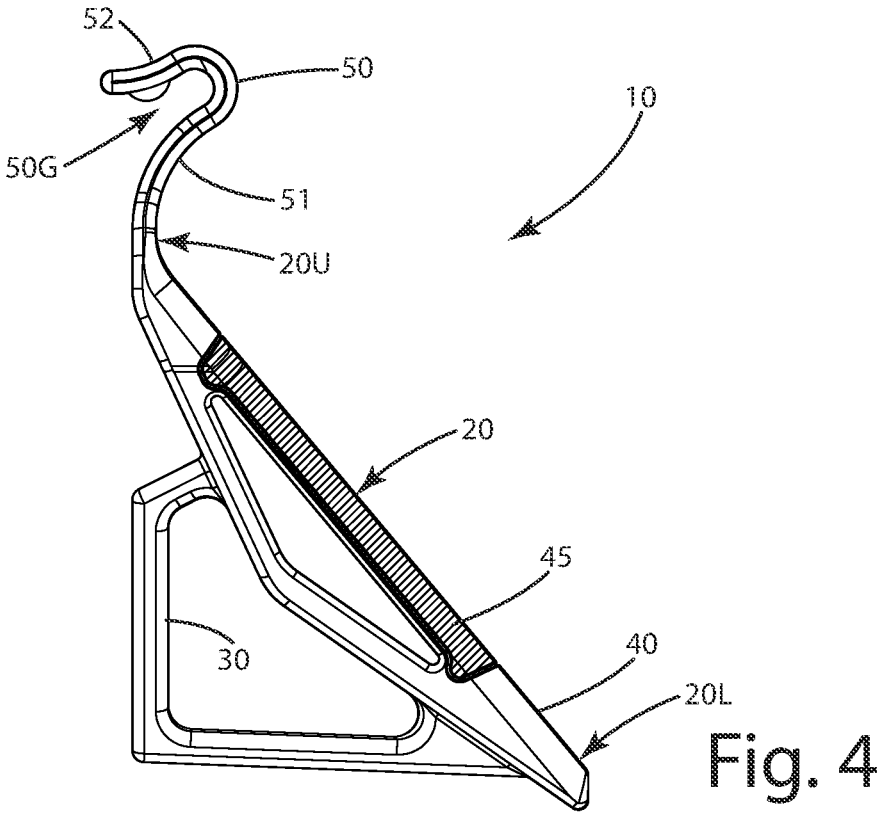
FIG. 4 is a front view thereof.

An archery bow training aid in accordance with a current embodiment is illustrated in FIGS. 1-9 and generally designated 10. The training aid 10 as shown in FIGS. 2 and 3 is designed to be joined with an archery bow, which will be described generally here. The archery bow 100 can include a riser 101 that is joined at opposite ends with first and second limbs 102, 103, which may or may not include cams, depending on whether the bow is a compound bow, a recurve bow, a longbow or other type of vertical bow, any of which are compatible with the current embodiments. Between the limbs, a bowstring 104 extends. The bow can include one or more portions between the limbs, such as the riser 101. The riser can include a grip 106 located below a shelf 107. The shelf can include an upper surface 107A, and a shelf ridge 107R that projects laterally from the shelf, optionally in a cantilevered manner relative to the underlying grip 106. Although not shown, an arrow rest can be joined with the riser above the shelf 107, and an arrow can be placed on the arrow rest when also nocked on the bowstring 104.

The grip 106 can be located below the shelf 107. The grip can include a first lateral grip surface 106A and a second opposite lateral grip surface 106B. These grip surfaces can be parallel to one another on most risers, but of course can be offset at angles in some risers for certain applications. Optionally, the shelf ridge 107R can project beyond a reference line 106AR that is parallel to and aligned with the first lateral grip surface 106A. The shelf ridge 107R can extend optionally at least 1 mm, at least 2 mm, at least 3 mm, at least 4 mm, at least 5 mm, or between 1 mm and 15 mm beyond the reference line 106AR.

With reference to FIGS. 1-3, the training aid 10 can include a training aid body 20. The training aid body 20 can include multiple components, such as a base 30 and a finger rest 40 as well as a fastening element 50. The training aid body 20 can include an upper body portion 20U and a lower body portion 20L. The finger rest 40 and the base 30 can extend generally from the lower portion 20L toward the upper portion 20U. The base 30 can terminate short of the upper portion 20U, while the finger rest 40 can extend beyond the base into the upper portion 20U. The base, as shown in FIGS. 1-6 can include an inner engagement surface 34 that is configured to engage and/or be placed in contact with the first lateral grip surface 106A. The base 30 optionally can include a first section 31 and a second section 32 that are separated by a gap G. The first and second sections can both be configured to engage the first lateral grip surface 106A and/or a portion of the shelf 107. The second section 32 can extend into and form a portion of the upper portion 20U of the body and some embodiments. The first and second sections also can be generally parallel to one another at their inner engagement surfaces, which are configured to engage the first lateral grip surface 106A. Those surfaces can be generally at 180° relative to one another.

The base 30 can be joined with the finger rest 40 via a lower arm 35 and an upper lateral arm 36. The lower arm 35 can extend outward from the base 30 a greater distance than the upper arm 36. An open hole 37 can be formed between and bounded by the upper arm 36, the lower arm 35 and the first section 31 of the base, as well as a portion of the finger rest 40.

The body 20 as mentioned above can include the finger rest 40. The finger rest 40 can include a finger rest surface 45 which can be configured to engage one or more fingers F of an archers hand H as shown in FIG. 2. The finger rest surface 45 can include a gripping element 45G. This element 45G can be a rubber, silicone or a polymeric material figured to provide slightly more grip and/or a different feel or touch then the remainder 45R of the finger rest surface 45.

As illustrated in FIG. 1, the finger rest surface and finger rest in general can be constructed so the finger rest surface is disposed at a first angle A1, optionally between 25° and 75°, inclusive, between 30° and 60°, inclusive, or between 30° and 50°, inclusive, relative to the first lateral grip surface 106A. This angle A1 can be substantially equal to an angle A2, which is the angle between the engagement surface 34 of the base 30 and the finger rest surface 45. As noted above, the first and second arms 35 and 36 extending from the base can hold the finger rest and thus the finger rest surface at these angles relative to the base and its components and/or the lateral grip surface. Of course, and certain applications, one or both of the arms 35 and 36 can be absent so that the finger rest surface and finger rest are cantilevered relative to the base 30 and/or body 20.

Figure 5:
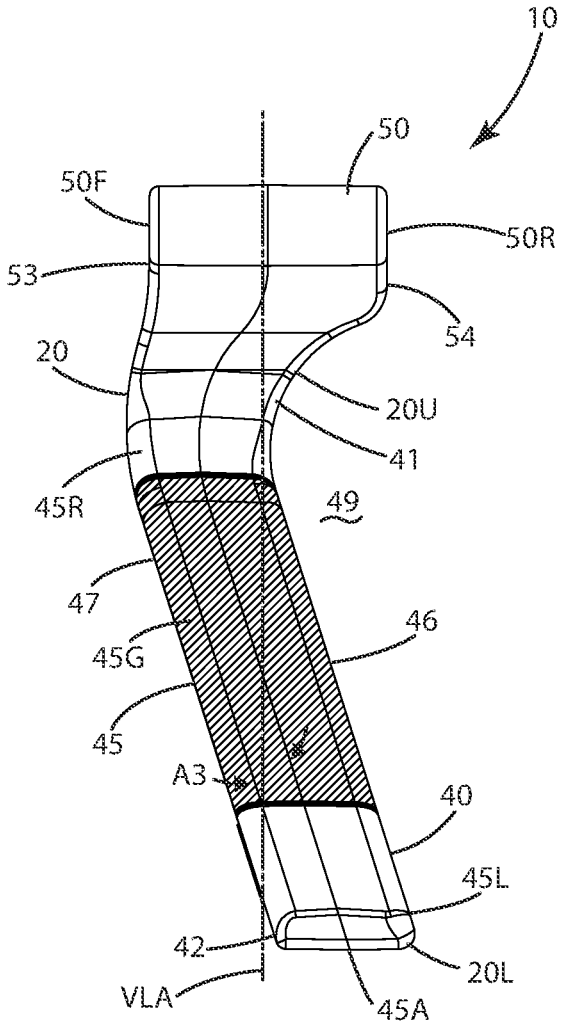
FIG. 5 is a left side view thereof.
Figure 6:
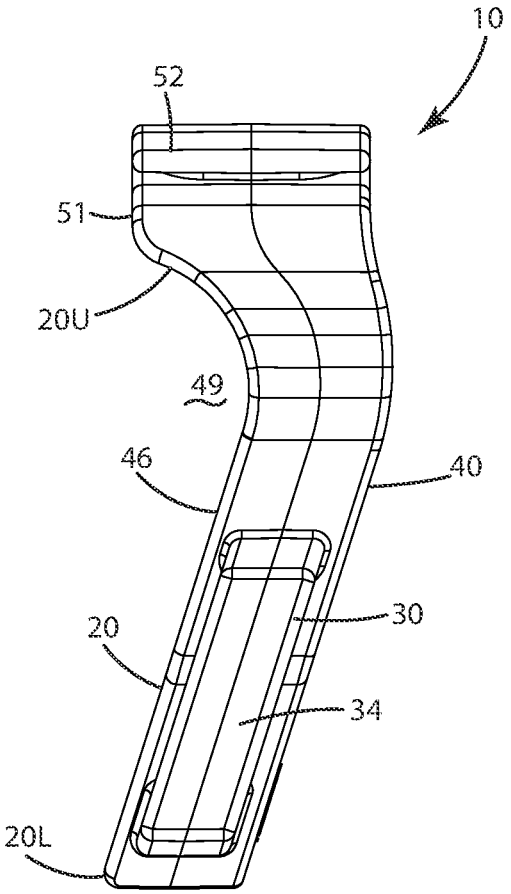
FIG. 6 is a right side view thereof.
Figure 7:
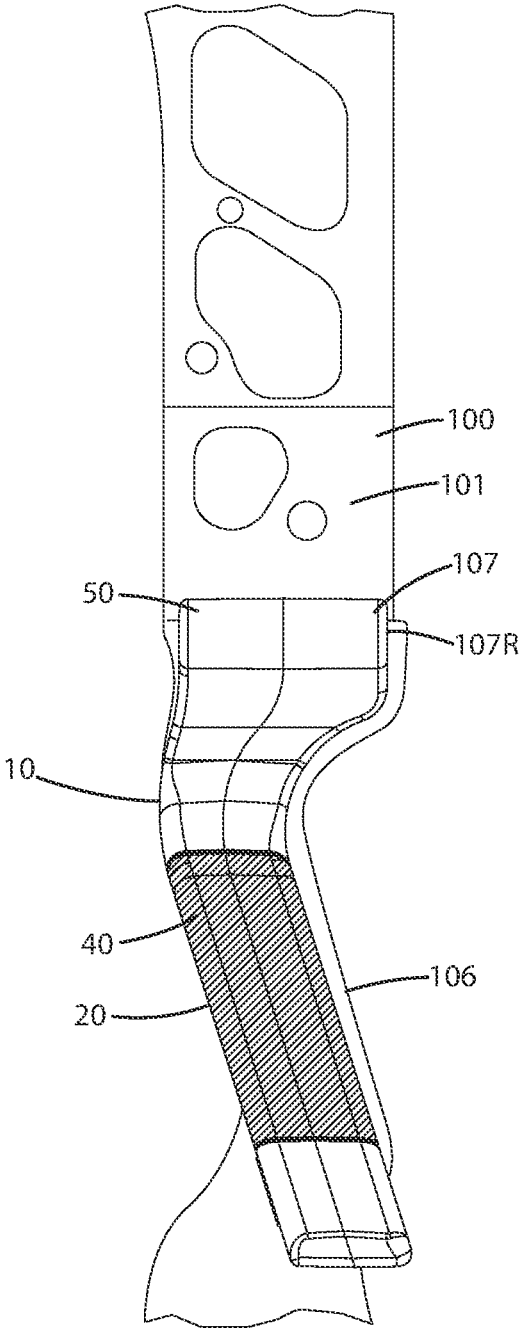
FIG. 7 is a left side view of the training aid installed on an archery bow adjacent a shelf and a grip of the bow.
Figure 8:
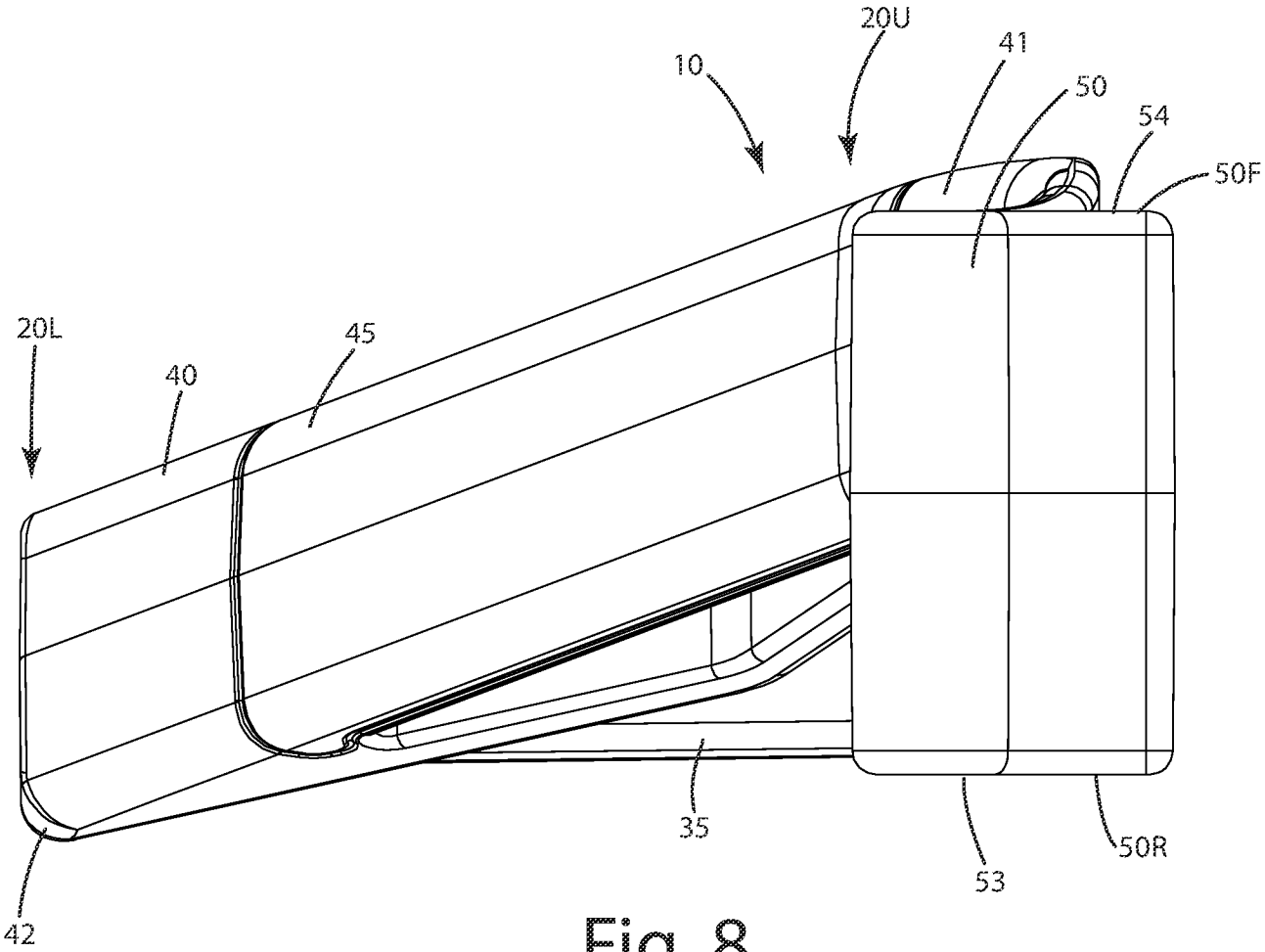
FIG. 8 is a top view of the training aid before installation on an archery bow.
Figure 9:
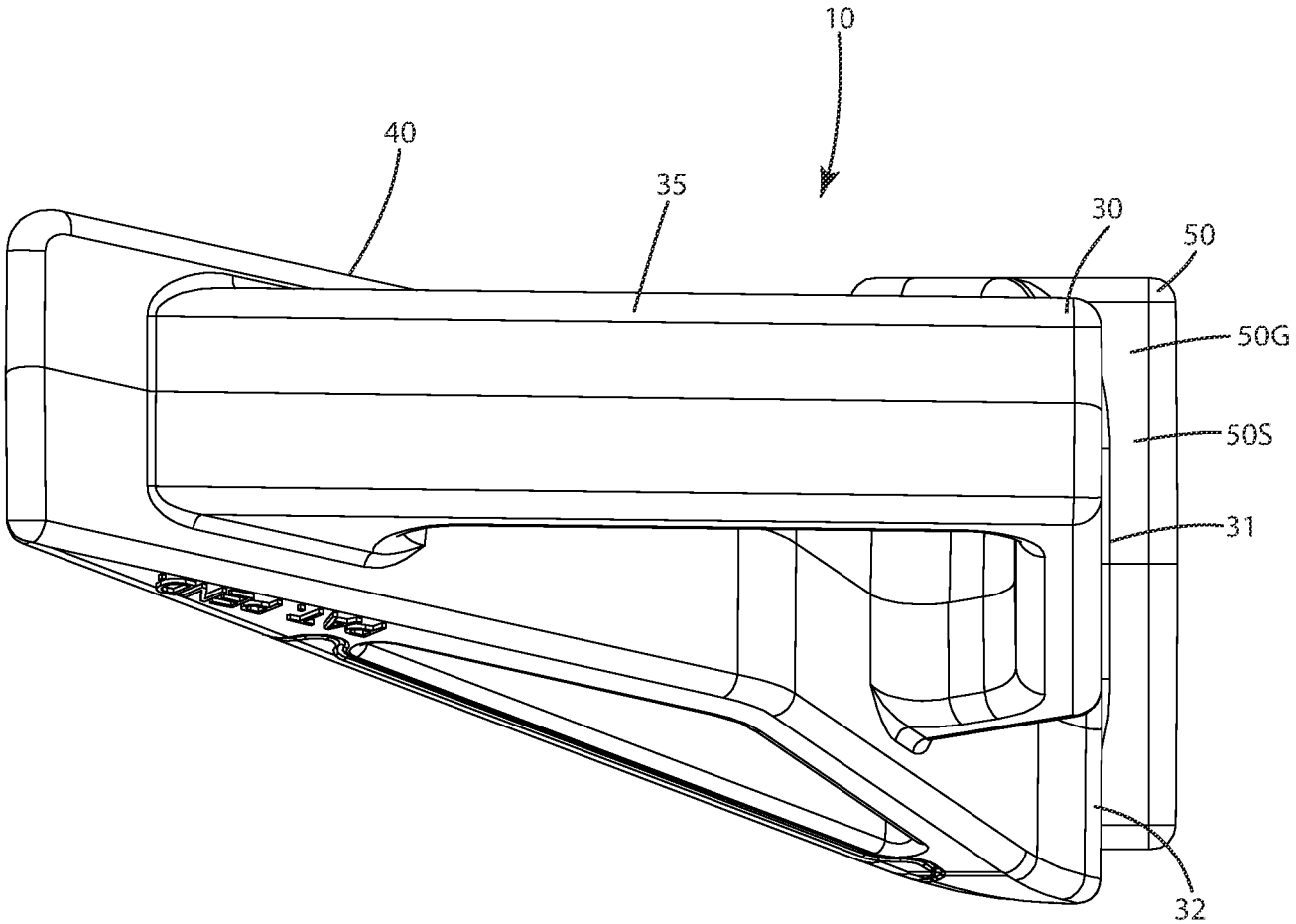
FIG. 9 is a bottom view thereof.

As shown in FIGS. 5-6, the finger rest 40 and the finger rest surface 45 can include a longitudinal axis 45A. This longitudinal axis 45A can be disposed at an angle A3 relative to the vertical axis VA of the training aid body 20. This angle A3 optionally can be between 0° and 45°, inclusive, between 0° and 35°, inclusive, or between 5° and 45°, inclusive, depending on the application. With this angle, the finger rest surface 45 is tilted rearward and disposed under the knuckles K of a user's hand H as shown in FIG. 2. Further, with this rearward swept finger rest and finger rest surface, the training aid is easier and more natural to engage by the hand H and or fingers F of a user.

The finger rest and finger rest surface are configured so that the fingers F of the hand H can contact the finger rest surface when the bow 100, in particular the grip 106, is grasped by a user. The fingers F as noted above are joined with their corresponding knuckles K. These knuckles can be aligned along a knuckle reference line KL, which can generally be a line that extends through each of the knuckles when the hand is in a semi-relaxed or relaxed state. The training aid 10 can be configured so that it holds or disposes the fingers in a particular manner so that the knuckle reference line KL of the hand H aligns generally at an angle A4 optionally between 25° and 75°, inclusive, between 30° and 60°, inclusive, or between 30° and 50°, inclusive, relative to the first lateral grip surface 106A.

The finger rest 45 as shown in FIGS. 5-6 also can include a rearward surface or edge 46 and a forward surface or edge 47. These rearward and forward surfaces also can be disposed at the angle A3 relative to the vertical axis VA of the body 20. The rearward surface 46 can extend along the rear of the finger rest and the finger rest surface 45. This rear edge 46 can be at least partially engaged by the palm P of the user's hand H, while the opposing front surface or front edge 47 of the finger rest 40 might not be engaged by any of the user's fingers F as the bow is being held. Of course, in some cases, one or more of those fingers F may slightly engage that front surface or edge 47. In addition, when the bow is being held, the thumb T of the user's hand H can be disposed adjacent a second lateral grip surface 106B of the grip 106 that is opposite the first lateral grip surface 106A.

Optionally, the finger rest 40 can include a first end 41 and a second end 42. The first end 41 can extend to and terminate at the upper portion 20U of the body 20. The second end 42 can extend downward and terminate at the lower portion 20L of the body 20. The lower or second end 42 can include a surface or corner 45L. This rearward surface or corner can extend rearward of the fastening element 50, particularly where the fastening element 50 is a clip as will be described below. Further optionally, between the lower or second end 42 and the fastening element 50, the body 20 can form a concave recess 49. This concave recess can be configured to receive the user's fingers and/or hand in such a manner so as not to distort them from a natural position and orientation relative to the grip 106. This concave recess can be formed generally by the rear surface 46 of the finger rest 40 and a portion of the upper portion 20U of the body, and in some cases a portion of the fastening element 50.

The training aid 10 as mentioned above includes a fastening element 50 that is integrally formed with the body, and optionally extends from the upper body portion 20U. This fastening element 50 as illustrated is in the form of a clip. The clip can include a first arm 51 and a second arm 52. The first and second arms can be separated by a gap 50G. The clip can further include a front opening 50F, a rear opening 50R and a side opening 50S, all of which can be contiguous with and in communication with the gap 50G. The front chip edge 53 can generally bound the front opening 50F while a rear edge 54 can generally bound the rear opening 50R. A side edge 55 and a portion of the body 20, for example the upper portion 20U and/or the base 30 and its second portion 32, can bound the side opening 50S.

The clip 50 and gap 50G can be configured to receive a portion of the bow 100, for example a portion of the riser 101. As shown, the gap 50G can be sized to receive the portion of the shelf 107, for example, the shelf ridge 107R that extends from the shelf 107, as will be described below. The clip can include a first clip arm 51 and a second clip arm 52. These arms can be configured to be spread away from one another, which can include both of the arms moving away from one another, or one or two of the arms spreading away from the other when a portion of the bow, such as the shelf ridge 107R is pushed into the gap 50G. The first and second arms can bias toward one another to capture the portion of the bow, for example, the shelf ridge 107R there between, after the first arm and second arm are spread away from one another.

In some applications, the clip 50 can include a protrusion 52P. This protrusion optionally can extend from the second arm 52, but in other cases it can extend from the first arm 51 or other portions of the clip or fastening element 50. This protrusion can extend along a lower surface 52L of the arm 52, but optionally can terminate short of the front 53 and rear 54 edges of the fastening element 50. The protrusion 52P can be configured to fit into a recess 107H that is defined by the riser 101, optionally in the shelf 107 and further optionally in the shelf ridge 107R. The interaction of the protrusion and the recess can help secure the fastening element 50 and thus the body 20 and aid 10 to the archery bow 100. In some cases, when the protrusion enters the recess, it can make an audible snap or click to confirm for the user that the clip is secured to the shelf. In some applications, shown in FIG. 3, the protrusion 52P can be spaced a distance D1 from the first arm 51. This distance D1 can correspond to a thickness of the shelf ridge or shelf in general. The remainder of the lower surface 52L can be disposed a second distance D2 from the first clip arm 51. The second distance can be greater than the first distance.

As shown in FIGS. 1 and 2, when the clip 50 is secured to the shelf 107A and/or shelf ridge 107R, the base inner engagement surface 34 can be parallel to and can contact and engage the first lateral grip surface 106A. The clip 50 can conform the body 20 against the grip such that the training aid body 20 cannot be removed from the bow without applying a force optionally of at least 1 pound, at least 2 pounds, at least 3 pounds, at least 4 pounds, at least 5 pounds, between five and 7 pounds or between 5 pounds and 10 pounds, inclusive. In turn, this can secure well the body to the riser and provide a consistent and secure surface upon which the hand H can rest to establish proper grip about the grip of the bow without torqueing the bow as the bow is drawn.

The archery training aid 10 shown in the current embodiment is constructed for a right-hand bow. Of course, the training aid 10 can be produced in a mirror like construction to be used on a left-handed bow. Thus, there can be different left and right hand models of the training aid to assist archers when using right- or left-handed bows.

The various components of the body 20 can be integrally formed as a monolithic single piece unit. For example the base 30, finger rest 40 and fastening element 50 can all be formed from a unitary single piece of polymeric material. The body 20 can be constructed so that is substantially rigid and inflexible. For example, it can be constructed from a rigid polymeric material. In some cases, however, it can be somewhat flexible but still generally rigid and self-supporting. In such cases it can be constructed from rubber, silicone and/or TPU. Of course other materials, such as composites, metals, alloys and other materials can be utilized to construct the body. Moreover, as shown although shown as an integral single piece unit, the various components can be fastened to one another.

A method of using the training aid 10 of the current embodiment will now be described. The method can include securing the training aid body 10 to the archery bow 100 in a fixed orientation relative to the grip 106 of the bow and grasping the bow and in general the grip and the training aid body 20 with a hand H so that fingers of the hand are adjacent the finger rest surface 45 such that a knuckle reference line KL of the hand aligns generally at an angle between optionally 20° and 75°, inclusive, 30° and 60°, inclusive, or 30° and 50° inclusive, relative to the first lateral grip surface 106A. A thumb of the hand can be disposed adjacent the second lateral grip surface 106B of the grip 106 opposite the first lateral grip surface 106A. When the user draws the bow 100, and in particular, draws the bowstring 104 away from the grip 106A and/or shelf 107, the training aid 10 positions the hand, knuckles and fingers so as to reduce torque applied to the archery bow via the hand on the grip. The archery training aid helps align the hand, and in particular the palm P, with the rear surface of the grip 106 so that the hand does not apply torque to the bow when the archery bow is drawn.

Figure 10:
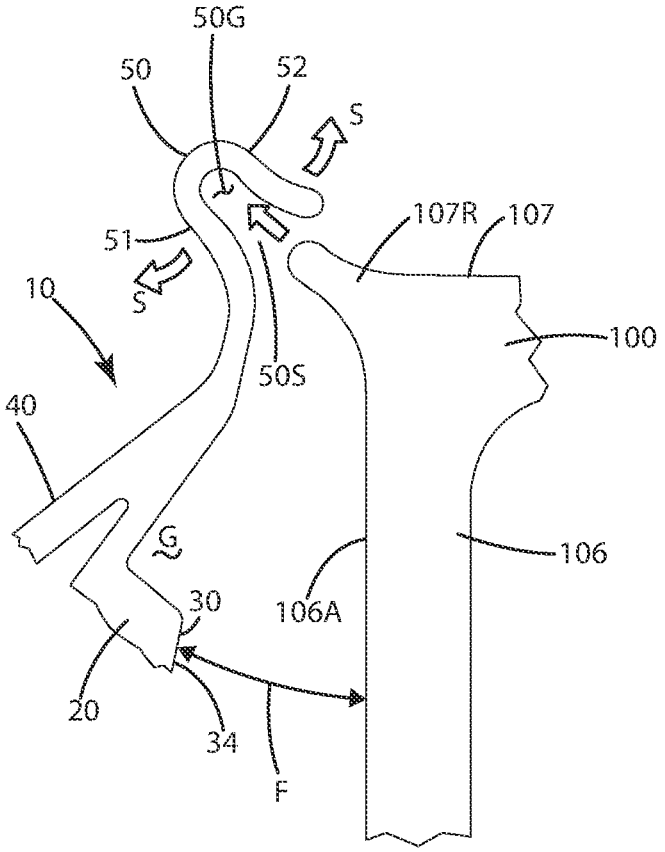
FIG. 10 is a side view of the training aid being installed on a shelf ridge of an archery bow.

The method can include other steps. For example, the method optionally, can include steps to secure the training aid body 10 to the bow 100, and in particular, the riser. For example, where the body 10 includes a fastening element, that fastening element can be joined with a portion of the archery bow, for example the riser, grip and/or shelf. In one embodiment, a portion of the archery bow can be inserted into the fastening element and the training aid body can be moved toward the grip, for example, the first lateral grip surface. More particularly, where the fastening element 50 is in the form of a clip, it can be joined with the upper body portion of the training aid body. The inserting can include, as shown in FIG. 10, moving the portion of the bow 100, for example the shelf ridge 107R into the gap 50G defined between the first arm 51 and the second arm 52. As the shelf ridge moves into the gap 50G, the surfaces of the shelf ridge can engage the inner surfaces of the clip arms 51 and 52 to move them apart from one another in direction S so that the shelf enters into the gap 50G. As shown there, the shelf ridge 107R enters the side opening 50S, adjacent the side edge 55, to enter the gap 50G as the clip is moved generally toward the shelf 107A and/or the grip. The first and second arms can be pushed away from another with the shelf ridge or another portion of the shelf or bow during the inserting step optionally, where there is a protrusion as shown in FIG. 3, that protrusion can fit into a recess defined by the shelf or shelf ridge. When it enters the same, it can audibly snap or click into place.

The fastening element 50, when in the form of a clip, can be extended substantially horizontally over the shelf 107 of the riser 101. For example, the second arm 52 can extend generally laterally over and adjacent the upper surface of the shelf 107A. That arm can also extend over an upper surface 107A of the shelf ridge 107R. The first arm 51 however can extend downwardly, along a lower surface of the shelf and/or shelf ridge toward the first lateral grip surface 106A. A portion of that arm and/or the base can thus extend substantially vertically adjacent that first lateral grip surface. Of course, with other configurations of the clip 50, the different components can extend horizontally and/or vertically adjacent different portions of the archery bow.

The use of the training aid 10 also can include moving, tilting or and/or rotating the training aid body 10 toward the first lateral grip surface, for example in direction F as also shown in FIG. 10. This movement or rotation can occur while the ridge is inserted into the clip to the side opening 50S. The base 30 can tilt or move toward the first lateral grip surface. Ultimately, the inner engagement surface 34 can engage against the first lateral grip surface 106A. The first and second sections of the base also can engage against that surface, while a gap G disposed between that lateral surface and the finger rest 40.

Optionally, in some cases, the fastening element 50 can secure the training aid body 22 the bow and a slightly different manner. During such securing, the portion of the bow, for example, the shelf 107A or the shelf ridge 107R can be slid into the fastening element, where it is a clip, through the front opening 50F and/or the rear opening 50R near the front edge or rear edge of the body 20. In this manner, the sliding action can spread the first and second arms of the clip away from one another so that the shelf ridge can enter into the gap, sliding along and relative to the surfaces of the clip during the same action. When the optional protrusion 52P aligns with the hole 107H in the shelf, the protrusion can enter that hole. Of course, where the protrusion and hole are absent, this interaction will not occur, and the clip arms can clampingly engage the shelf ridge, shelf and/or grip to secure the training aid in a fixed, stationery orientation relative to the bow.

When the fastening element secures the body 20 to the bow, the base 30 can engage the first lateral grip surface 106A. The finger rest 40 and the finger rest surface 45 can project outward, away from the bow and lateral grip surface at the offset angles mentioned above. Again, a user can then grasp the bow for example as shown in FIG. 2. The user can place their palm P on the rear surface of the grip. The thumb can extend adjacent the second lateral surface 106B of the grip 106. The fingers F and knuckles K can extend over the finger rest 40 and the finger rest surface 45. The knuckles can align generally along a knuckle reference line KL. Which can be disposed at the angle A4 as mentioned above. In this configuration, the training aid 10 can generally align the user's hand with the grip so that it takes on a neutral position and is impaired from or prevented from inducing torque on the grip which can later alter the flight of an arrow shot from the bow 100.

Figure 11:
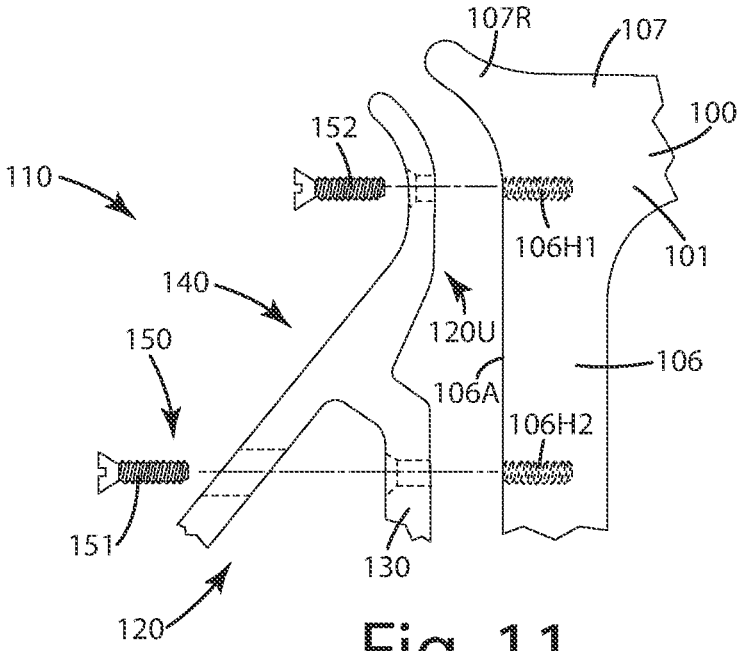
FIG. 11 is a side view of a first alternative embodiment of the training aid.
Figure 12:
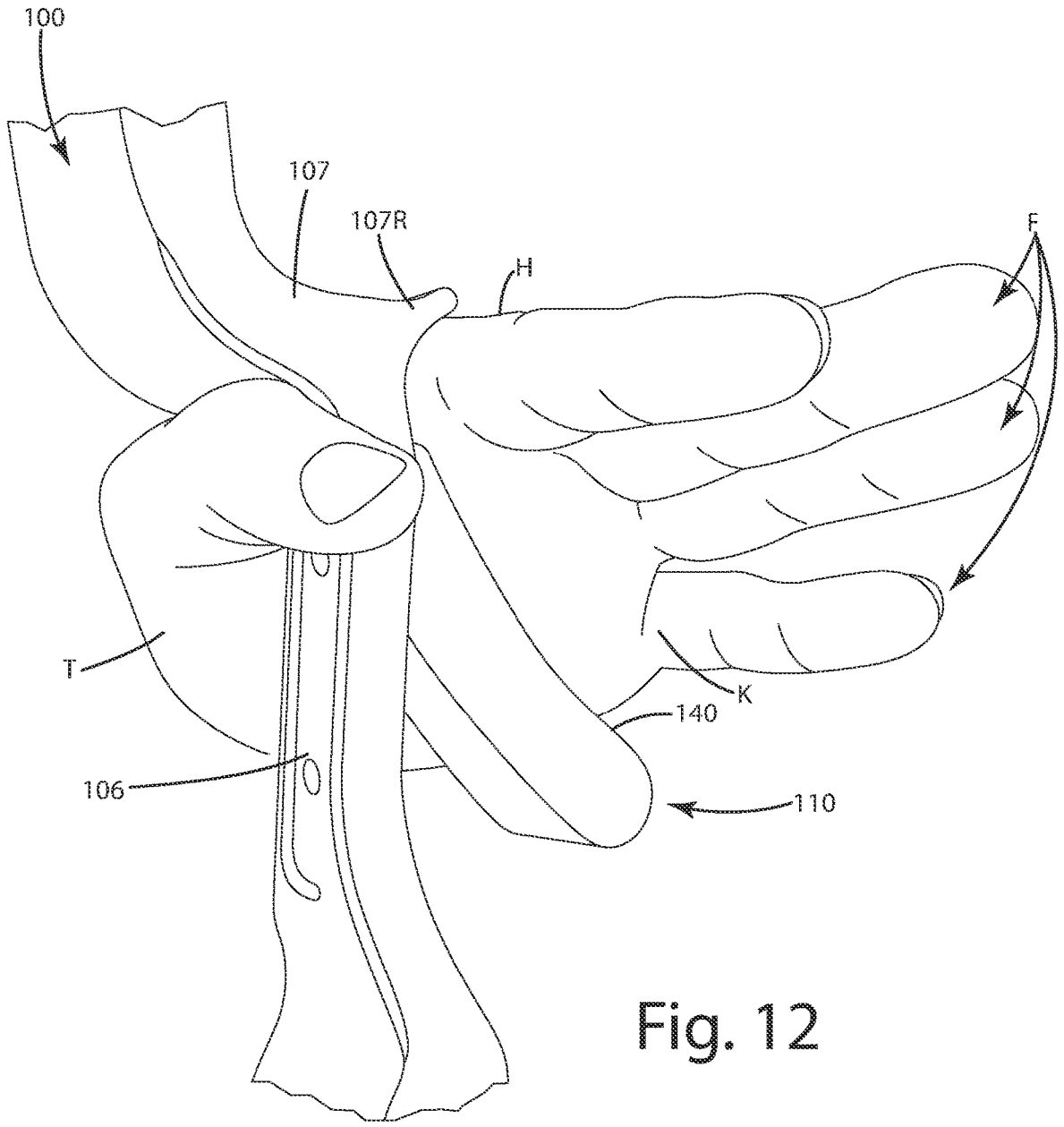
FIG. 12 is a front perspective view of the first alternative embodiment of the training aid installed on an archery bow and positioning an archer's hand as the hand engages the grip.

An alternative embodiment of the archery training aid is illustrated in FIGS. 11-12 and designated 110. This embodiment is similar in structure, function and operation to the embodiment described above with several exceptions. For example, the training aid can include a body 120, a base 130 and a finger rest 140. These elements can be similar to the same features in the embodiment above. In this embodiment however, the fastening element 150 can be in the form of one or more fasteners 151 and 152. These fasteners can extend through a portion of the body 120 and into corresponding threaded holes 106H1 and 106H2 defined by the first lateral grip surface 106A and/or the grip 106 or the bow 100 in general. These fasteners 151 and 152 can include heads that engage portions of the base 130 and/or the finger rest 140 so that the heads pull the body 120 into close engagement with the grip 106 and thereby secure the body 120 and the training aid 110 to the archery bow 100 and grip 106. Optionally, the fastening element can be in the form of double-sided tape or an adhesive strip, that is placed between and adheres to the grip 106 as well as the base 130 or body 120.

When the aid is secured to the bow, as shown in FIG. 12, it can be used in conjunction with the properly align a user's hand, in particular the knuckles and fingers and palm with the bow grip, to properly grasp the bow grip to reduce and/or eliminate bow torque, similar to the embodiment described above.

Optionally, in this construction, no portion of the body 120 extends upwardly and over the shelf 107 or the shelf ridge 107R. Instead, these components of the body can be disposed below these other elements, and generally adjacent the first lateral grip surface 106A. Further optionally, in some cases, the base 130 can be deleted from the body 120. In such a construction, the fastening element 150 can include the faster 152 in the upper portion 120U of the body. This fastener 152 can secure the aid to the bow by itself, such that the finger rest projects adjacent the grip in a cantilevered manner.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A method of using an archery bow training aid, the method comprising:

providing an archery bow including a grip;

providing a training aid body having a base and a finger rest extending from the base, the base having an engagement surface, the finger rest having a finger rest surface;

placing the engagement surface adjacent the archery bow so that the finger rest surface is disposed at a first angle between 30° and 50°, inclusive, relative to a first lateral grip surface;

securing the training aid body to the archery bow by clipping a clip joined with the training aid body to the archery bow so that the training aid body projects laterally outward from the first lateral grip surface; and grasping the grip and the training aid body with a hand so that a plurality of fingers of the hand contact the finger rest surface and so that the finger rest surface thereby aligns a knuckle reference line of the hand generally at a second angle between 25° and 65°, inclusive, relative to the first lateral grip surface, with a thumb of the hand being disposed adjacent a second lateral grip surface of the grip opposite the first lateral grip surface, whereby torque applied to the archery bow via the hand is reduced.

2. The method of claim 1, wherein the clip is the only structure securing the training aid body to the archery bow.

3. The method of claim 1,
wherein the clip includes a first arm and a second arm with a gap therebetween,
wherein the securing includes placing a shelf at least partially in the gap.

4. The method of claim 3,
wherein the clip includes a front opening, a rear opening and a side opening,
wherein the securing includes pushing a portion of the shelf into the gap through the side opening.

5. The method of claim 1,
wherein a grip is disposed below a shelf of the archery bow,
wherein the clip extends from the training aid body,
wherein the clip is distal from the grip when the engagement surface is disposed adjacent the grip.

6. The method of claim 5,
wherein the clip extends upward from the training aid body such that the clip is vertically above the grip.

7. The method of claim 1,
wherein the training aid body is placed against a grip of the archery bow,
wherein the clip clips to the archery bow distal from the grip.

8. The method of claim 1,
wherein the training aid body separates the hand from an first lateral grip surface so that the hand does not engage the grip along the first lateral grip surface during the grasping.

9. The method of claim 8,
wherein the training aid is removable from the first lateral surface and the grip.

10. A method of using an archery bow training aid, the method comprising:
securing a training aid body, constructed from a rigid polymeric material, to an archery bow with a fastening element in a fixed orientation relative to a grip of the archery bow and under a shelf of the archery bow, the training aid body having a base and a finger rest extending outward from the base, the base being adjacent a first lateral grip surface of the grip so that the finger rest is disposed at a first angle between 25° and 65°, inclusive, relative to the first lateral grip surface; and
grasping the grip and the training aid body with a hand so that a plurality of fingers of the hand are adjacent the finger rest surface, and so that the finger rest surface thereby aligns a knuckle reference line of the hand generally at a second angle between 30° and 50°, inclusive, relative to the first lateral grip surface, with a thumb of the hand being disposed adjacent a second lateral grip surface of the grip opposite the first lateral grip surface,
wherein the training aid body is a separate component from the grip,
wherein the training aid body is removable from the archery bow upon disconnection of the fastening element.

11. The method of claim 10,
wherein the fastening element is a clip,
wherein the securing includes clipping the clip to the archery bow.

12. The method of claim 11,
wherein the training aid body includes a bar projecting from the base and forming an opening between the bar and the finger rest surface.

13. The method of claim 12 comprising:
placing the bar so that it projects laterally away from the first lateral grip surface.

14. The method of claim 11 comprising:
moving the training aid body laterally toward the first lateral grip surface in a tilting motion toward the grip.

15. The method of claim 14 comprising:
tilting the finger rest downward toward the lateral grip surface.

16. An archery bow training aid comprising,
a base constructed from a rigid polymeric material;
a finger rest extending outward from the base, the finger rest including a finger rest surface configured to engage fingers of a hand, the base configured to be placed in engagement with a first lateral grip surface of a bow grip so that the finger rest surface is disposed at a first angle between 30° and 50°, inclusive, relative to the first lateral grip surface; and
a fastening element joined with at least one of the base and the finger rest, the fastening element configured to join to the archery bow to removably secure the base in a fixed orientation under a shelf of the archery bow, adjacent a grip of the archery bow.

17. The archery bow training aid of claim 16,
wherein the fastening element is a clip joined with at least one of the base and the finger rest,
wherein the clip is joined with the training aid body but does not form a part of the grip,
wherein the training aid body is removable from the first lateral grip surface.

18. The archery bow training aid of claim 16,
wherein the training aid body only engages the first lateral grip surface of the grip, without wrapping around the grip.

19. The archery bow training aid of claim 16, comprising:
an arm extending laterally outward from the base under the finger rest, with an open hole being defined under the finger rest, the open hole bounded at least partially by the arm, the base, and the finger rest, such that the finger rest is separated from the base by the open hole,
wherein the training aid body includes an upper body portion,
wherein the fastening element is joined with the upper body portion,
wherein the fastening element is configured to extend over a portion of the shelf when the base is adjacent the first lateral grip surface.

20. The archery bow training aid of claim 16,
wherein the fastening element is a clip joined with the training aid body,
wherein the clip does not form a part of the grip,
wherein the training aid body removably clips to the archery bow and is held in place via a clamping force exerted via the clip.

* * * * *